United States Patent [19]
Kilichowski
[11] 4,249,107
[45] Feb. 3, 1981

[54] CATHODE RAY TUBE HAVING AMORPHOUS RESISTIVE FILM ON INTERNAL SURFACES AND METHOD OF FORMING THE FILM

[75] Inventor: Kurt B. Kilichowski, Burlington, Mass.

[73] Assignee: GTE Laboratories Incorporated, Waltham, Mass.

[21] Appl. No.: 865,629

[22] Filed: Dec. 29, 1977

Related U.S. Application Data

[62] Division of Ser. No. 634,675, Nov. 24, 1975, Pat. No. 4,092,444.

[51] Int. Cl.³ ..... H01J 29/88; H01J 29/94
[52] U.S. Cl. ..... 313/479
[58] Field of Search ..... 313/450, 479

[56] References Cited

U.S. PATENT DOCUMENTS

| | | | |
|---|---|---|---|
| 2,564,707 | 8/1951 | Mochel | 428/539 X |
| 2,934,736 | 4/1960 | Davis | 427/126 X |
| 3,138,734 | 6/1964 | Lineweaver | 313/450 X |
| 3,295,008 | 12/1966 | Gallaro et al. | 313/450 X |

*Primary Examiner*—Robert Segal
*Attorney, Agent, or Firm*—David M. Keay

[57] ABSTRACT

An amorphous, resistive thin film is deposited on internal surfaces of portions of a cathode ray tube by the pyrolysis of a liquid mixture of colloidal graphite and a heavy metal resinate to produce a film which is a mixture of graphite and the oxide of the metal. The metal resinate is a combination of tin and antimony resinate. The film is deposited on the tube neck in the region of the G3 and G4 electrodes to impede arcing. The amorphous film is also deposited on the tube funnel in the region extending from the snubber contact locations up to the anode voltage terminal. The pyrolysis of the heavy metal resinate and colloidal graphite results in a film having a resistance ranging from $10^3$ to $10^8$ ohms point to point. The amorphous film which does not require a binder, has good adhesion and scratch resistance characteristics, thereby reducing conductive particle contamination.

4 Claims, 1 Drawing Figure

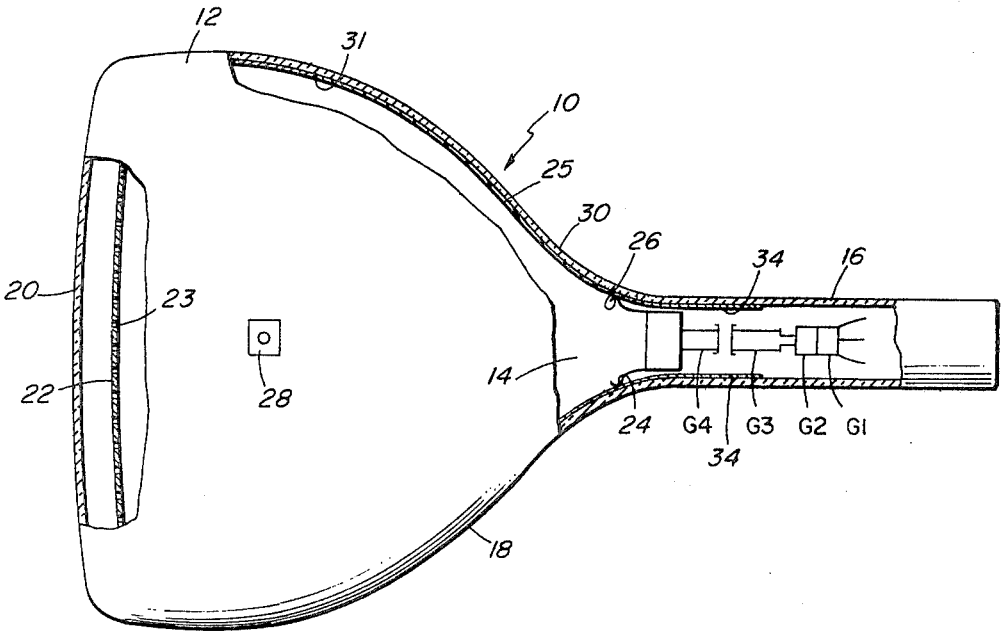
12
31
10
25
30
26
34
16
20
23
22
28
14
24
G4
G3
G2
GI
34
18

CATHODE RAY TUBE HAVING AMORPHOUS RESISTIVE FILM ON INTERNAL SURFACES AND METHOD OF FORMING THE FILM

This is a division, of application Ser. No. 634,675 filed Nov. 24, 1975 now U.S. Pat. No. 4,092,444.

BACKGROUND OF THE INVENTION

The present invention relates to resistive thin films in cathode ray tubes for arc suppression.

Arcing in cathode ray tubes used in color television is not a new phenomenon. Arcing occurs in the electron gun area of the cathode ray tube and causes damage to both the electron gun and the electronic circuitry which is responsible for the operation of the gun. The problem has become potentially more serious because of the trend towards the use of higher operating potentials (up to 30 kv) to enhance the brightness of the picture. There are several mechanisms by which arcs may occur and cause voltage/current fluctuations which are responsible for electron gun damage. Examples of these mechanisms include field emission in the G3–G4 region of the tube neck and conductive particle contamination. It is known to coat the neck portion of the cathode ray tube with a resistive thin film to reduce field emission. It is also known to deposit a highly conductive graphite film on the tube funnel. However, if the film deposited in either of these regions does not have adequate scratch resistance and adhesion characteristics, particles of this film may break loose and contaminate the tube, thereby causing the arcing problem previously referred to. Loose particle contamination arises from the frictional effect of the snubber contacts connected to the G4 electrode being in contact with the graphite film in the funnel region. Further, contamination also occurs merely from normal manufacturing procedures and from normal use.

One known tube having such a resistive thin film on both the neck and funnel of the tube is described in U.S. Pat. No. 3,355,617 to Schwartz et al. The film on the neck region is formed by applying a liquid coating of $Fe(NO_3)_3.9H_2O$ and $Mn(NO_3)_2$ (51% sol.) and $H_2O$. The coating is then baked to drive off the water and decompose the nitrates, yielding a film essentially of oxides of iron and manganese and having an electrical resistance in the range of $10^9$ to $10^{12}$ ohms per square. The tube funnel is coated with colloidal graphite to produce a highly conductive film. However, films produced in such a manner could never be made less resistive without additional components. A uniform mixture which could be used for both neck and funnel areas is desirable. Also the salts mentioned in the Schwartz patent are in an aqueous solution. In order to bake out such a tube and to be sure no residual water remains, two firing steps are necessary which is highly uneconomical.

To enhance the adherence characteristic of the film there are several known film compositions which include a binder. A typical binder containing film is that described in U.S. Pat. No. 3,791,546 to Maley. The coating formulation of this patent includes a liquid solution of $Fe_2O_3$ particles, graphite particles and a sodium silicate ($Na_2O:SiO_2$) binder. However, the use of a binder complicates the film forming procedure. Also, while the binder may enhance the adherence characteristic of the film, it may degrade the scratch resistance characteristic. Lastly, silicates are hydroscopic and bind $H_2O$ which poisons cathodes.

SUMMARY OF THE INVENTION

It is an object of the present invention to provide in a cathode ray tube a resistive thin film which has a non-crystalline or amorphous form to provide enhanced adherence and scratch resistance characteristics.

It is an additional object of the present invention to form the film by a process which is consistent with standard production procedures in the manufacture of color television picture tubes.

It is still an additional object of the present invention to provide a film which does not require the use of a binder.

It is a further object of the invention to provide a cathode ray tube having an amorphous film composition on the tube funnel region so that conductive particle contamination due to the snubber in contact with the film is reduced.

Accordingly, the present invention relates to a method of forming a resistive thin film on an internal portion of the cathode ray tube and the improved tube made by the method. The method includes the steps of coating the internal portion with a liquid including effective portions of graphite in a suitable carrier and a resinate of a heavy metal selected from the group consisting of antimony and tin and mixtures thereof, and then heating the coating liquid to produce the amorphous film which is a mixture of graphite and an oxide of the heavy metal. The pyrolysis of the metal resinates with the graphite provides a film with an amorphous configuration thereby providing enhanced scratch resistance and adherence. The method does not require the use of a binder. In a preferred embodiment of the method according to the invention, the preferred heavy metal is a mixture of antimony and tin, and the preferred resinate is 2-ethylhexante; however, other organic acid ligands may be substituted.

The improved tube according to the invention has a resistive thin film on the tube neck portion near the G3 and G4 electrodes, the film being amorphous and consisting of a mixture of graphite and an oxide of a heavy metal. The film has an electrical resistance in the range from $10^3$ to $10^8$ ohms point to point, and preferably in the range from $10^5$ to $10^6$ ohms point to point. The film includes graphite and the oxides of tin and antimony. The film is also deposited on the tube funnel in the region where the snubbers connected to the G4 electrode contact the funnel region. The amorphous quality of the film provides excellent adherence and scratch resistance characteristics to reduce conductive particle contamination.

BRIEF DESCRIPTION OF THE DRAWING

In the drawing:

FIG. 1 is a partial sectional view of a cathode ray tube having a resistive thin film according to the present invention deposited on the inner surface of the funnel and the neck regions.

DESCRIPTION OF PREFERRED EMBODIMENTS

In an exemplary embodiment of the present invention, as illustrated in FIG. 1, there is provided an improved cathode ray tube, indicated generally by the reference numeral 10. The tube 10 has an envelope 12 which is typically made of glass and which defines an evacuated internal region 14. The envelope 12 includes a neck portion 16 and a funnel portion 18. An electron gun is positioned in the neck portion 16 and provides a beam of electrons (not shown) for impingement on a faceplate 20 forming a part of the tube 10. A shadow mask 22 having formed therein an array of apertures 23 is positioned near the faceplate 20. In the gun, a cathode G1 is provided which normally is at −30 volts potential. Adjacent to cathode G1 is an electrode designated G2, which is nominally at 1 kilovolt potential. A lens cylinder G3 is adjacent to the G2 electrode and is typically at a potential of approximately 4 kilovolts. A G4 acceleration cylinder is also provided, the cylinder G4 being typically at a potential of approximately +25 kilovolts. A trio of snubber contacts 24 and 26 extending from the G4 cylinder contact the surface of a film 25 on the interior surface of the funnel 18 of the tube 10. In a conventional cathode ray rube, the film 25, known by the tradename Aquadag, is a mixture of graphite and a binder. This film 25 provides a highly conductive path between an anode button 28 and the snubber contacts 24 and 26. The anode button is the terminal for bringing into the tube the anode potential which typically is +25 kilovolts. In the present invention, the film 25 in the region between the anode button and the snubber contacts is a mixture to be described hereinafter, as opposed to the Aquadag film. The funnel portion between the faceplate 20 and the location 31 is coated with an Aquadag film (not shown).

According to the present invention, the region on the inner surface of the neck portion between the G4 and G3 electrodes is coated with an amorphous resistive thin film, designated generally by the reference numeral 34. Preferably, this amorphous thin film is also deposited on the funnel portion 18 up to the location 31 which is somewhat to the right of the anode button 28 as illustrated in FIG. 1. The amorphous film 34 consists of a mixture of graphite and oxides of heavy metals selected from the group consisting of antimony, tin and combinations thereof. The amorphous film should have an electrical resistance ranging from $10^3$ to $10^8$ ohms point to point. Preferably, the resistance ranges from $10^5$ to $10^6$ ohms point to point.

The method of forming the amorphous thin film on the tube neck and on the tube funnel comprises the steps of coating the internal portion of the tube with a liquid consisting of graphite in a suitable carrier and effective proportions of a heavy metal resinate selected from the group consisting of antimony, tin and combinations thereof and heating the coated liquid to produce an amorphous thin film which is a mixture of graphite and the heavy metal. Preferably, the resinate is 2-ethylhexanate and the carrier is isopropyl alcohol. In one preferred form of the method, the heavy metal is a combination of antimony and tin. Preferably, the step of heating the coated liquid includes heating at a temperature and for a time interval of 325° C. for 10 hours to 475° C. for 0.5 hours. Preferably, the coated liquid is heated to about a temperature of 430° C. for about 2 hours which is consistent with tube backout procedures in the manufacture of CRT's for television receivers. The step of coating the liquid may include spraying the liquid or brush coating the liquid onto the inner surfaces of the tube. When the heavy metal is a combination of antimony and tin, the liquid preferably contains concentrations of the resinates effective to produce substantially equal percentages of oxides of tin and antimony by weight.

The following comprises an example of the preparation of a coating solution according to the invention.

EXAMPLE

Prepare a stock solution containing 2.2% Sn and Sb by weight, respectively, by mixing suitable quantities of the resinate with toluene. The Sn and Sb resinates used are commerically available from Englehard Industries, Inc. Hanovia Liquid Gold Division, East Newark, New Jersey. The Englehard antimony contains 15% antimony by weight, and toluene, xylene and essential oils. The Englehard tin resinate used is identified as No. 118-b and contains 3.1% tin and mercaptan base. For every four grams of this dilute Sn and Sb resinate, add 1 gram of Isopropyl Dag No. 154 which may be obtained from Achenson Colloids. This carrier-supported graphite solution contains 10% by weight graphite particles. (<1 micron thickness in isopropyl alcohol). The resultant liquid containing graphite, tin resinate, antimony resinate and isopropyl alcohol is sprayed on the appropriate regions of the CRT. Finally, the liquid is heated from ambient temperature to 450° C. in over 0.5 hours, maintained at 450° C. for 1 to 2 hours and cooled to ambient temperature in about 0.5 hours.

Various tests were conducted to compare the resistive films made according to the method of the present invention with resistive films produced according to the teachings of U.S. Pat. No. 3,791,546 to Maley. Several samples by each method were made so that the samples contained 100–0% oxides and 0–100% carbon. By varying the concentrations of constituents, a range of resistance values was obtained from $10^3$ to $10^8$ ohms point to point. The resultant solutions were mixed thoroughly and sprayed on 2″×3″ sample slides which were then fired at 430° C. for 2 hours thereby simulating production firing conditions.

The Sn-Sb resinates were prepared according to the Example except to the extend that the carbon to metal oxide combinations differed. Regarding the inorganic system taught by the Maley patent, a different series of solutions were prepared using a slurry of particulate $Fe_2O_3$, 20% in 20% aqueous sodium silicate solution for a binder. Varying amounts of the $Fe_3O_3$/aq. silicate stock solution were mixed with respective varying amounts of an aqueous graphite solution, such as available from Achenson Colloids under the tradename Aquadag, to produce 0–100% C respectively. Sample slide preparation by spraying, firing, and electrode deposition followed the same procedure used for the antimony-tin resinate-isopropyl dag film of the Example. The samples were tested for resistance, examined under a scanning electron microscope and given an adhesion and scratch resistance test. The evaluation of the resistance data shows that resistive films of preferred electrical characteristics (0.5 megohm point to point) can be obtained from both resinate films and from the organic FeO-C film. The primary differences between films with 0.5 megohm resistance being the amount of graphite required and the physical characteristics of each of the pyrolyzed films. A great deal of flexibility can be afforded to the resistive coatings. Recalling that resistance is a function of geometry, a more conductive film may be applied in a broader band (>2″) and achieve the same resistive value as a less conductive film on a 2″ band. This allows the entire funnel (from 1″ below the button to the snubber region) to be coated if desired. The desirable aspect of a wider band lies in the adherence properties of the pyrolyzed films vs. the current state of the art Aquadag coating.

Scanning electron micrographs of the pyrolyzed resistive thin film were obtained. The topographical photographs were taken employing 3000× magnification. These photographs show that the films produced from the organic resinate solutions are much smoother and more continuous in appearance than those of the inorganic film taught by the Maley patent. The explanation for this difference lies in the nature of the particle in each case. The metal oxides produced as a result of resinate pyrolysis have no definite crystalline structure and are amorphous particles as seen from X-ray data. The inorganic iron oxide powder used, although milled, contained crystalline particles of considerable size (10–18 μm).

The adhesion of films placed inside CRT's is an important factor. Particles that might be shaken loose during production and handling can initiate arcing. Spot knocking usually removes those particles knocked loose during production, but the dislodging of particles during handling and moving is more difficult to prevent. Therefore, a film with good adhesion is necessary. The Scotch tape test is the method commonly employed and is a convenient check on adherence. The method is only of a semiquantitative nature, but does lead to a valid comparison of adhesion qualities of films. A piece of Scotch tape was pressed on the sample slides with a uniform motion, after which it was removed and examined for loose particles. When subjected to the Scotch tape test, films produced by the Sb/Sn resinate system and the inorganic $Fe_2O_3$ system yielded few, if any, loose particles.

The Scotch tape test can also be used in a semiquantitative manner for examining thin film scratch resistance. A snubber contact was used to make a hairline scratch in the films tested. Scotch tape was then applied to these regions, pressed on, and removed. The Scotch tape then indicates whether particles were loosened on both sides of the scratch, as they will be removed, or if it was of hairline nature with particles in direct contact remaining undisturbed. The films produced from the Sb/Sn resinate system exhibited hairline scratches with adjacent particles undisturbed. The behavior was different for the particulate $Fe_2O_3$/Aquadag system. When the Scotch tape was applied to the scratched area and removed, large loose particles were picked up from both sides of the area, indicating that these were mechanically loosened by scratching.

The embodiments of the present invention are intended to be merely exemplary and those skilled in the art shall be able to make numerous variations and modifications of them without departing from the spirit and scope of the present invention. All such variations and modifications are intended to be within the scope of the present invention as defined by the appended claims.

I claim:

1. In a cathode ray tube having an evacuated tube including an envelope having a neck portion and electron gun positioned in the neck portion to provide a beam of electrons for impingment on a target forming a part of the tube, the gun including a plurality of electrodes operating at varying potentials, the neck portion including an interior surface portion adjacent to the electrodes, the electrodes and the potentials being such that an arc discharge may occur between electrodes of varying potentials, the improvement comprising:

(a) an amorphous, resistive thin film deposited on the interior surface of the neck portion adjacent to the electrodes, the film consisting of a mixture of graphite and oxides of heavy metals selected from the group consisting of antimony and tin and combinations thereof, the amorphous film having an electrical resistance ranging from $10^3$ to $10^8$ ohms, and having good adhesion and scratch resistance qualities without a binder.

2. The improvement according to claim 1 wherein the tube has a funnel portion between the neck portion and the target and at least one electrode has snubber contacts for contacting an adjacent portion of the inner funnel wall and wherein the amorphous resistive film is deposited on at least the adjacent portion of the funnel so that the snubber contacts are in electrical contact therewith.

3. The improvement according to claim 1 wherein the thin film is a mixture of oxides of tin and antimony of approximately equal percentages by weight.

4. The improvement according to claim 2 wherein the resistance ranges from $10^5$ to $10^6$ ohms.

* * * * *